US010134520B2

(12) United States Patent
Moon

(10) Patent No.: US 10,134,520 B2
(45) Date of Patent: Nov. 20, 2018

(54) COIL ELECTRONIC COMPONENT

(71) Applicant: SAMSUNG ELECTRO-MECHANICS CO., LTD., Suwon-si, Gyeonggi-do (KR)

(72) Inventor: Byeong Cheol Moon, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/077,405

(22) Filed: Mar. 22, 2016

(65) Prior Publication Data

US 2017/0053732 A1 Feb. 23, 2017

(30) Foreign Application Priority Data

Aug. 18, 2015 (KR) ..... 10-2015-0115949

(51) Int. Cl.
*H01F 27/29* (2006.01)
*H01F 5/00* (2006.01)
*H01F 17/04* (2006.01)

(52) U.S. Cl.
CPC ..... *H01F 27/292* (2013.01); *H01F 17/04* (2013.01); *H01F 2017/048* (2013.01)

(58) Field of Classification Search
CPC ..... H01F 27/28; H01F 27/29; H01F 27/2804; H01F 27/292; H01F 2005/043; H01F 17/0006
USPC ..... 336/192, 200, 223
See application file for complete search history.

(56) References Cited

U.S. PATENT DOCUMENTS

| | | | | |
|---|---|---|---|---|
| 8,207,808 | B2 | 6/2012 | Yamada et al. | |
| 2006/0049907 | A1 | 3/2006 | Liu | |
| 2011/0260821 | A1* | 10/2011 | Yamada | H01F 27/292 336/192 |
| 2013/0027161 | A1 | 1/2013 | Urano | |
| 2015/0102891 | A1 | 4/2015 | Yoon et al. | |
| 2016/0247626 | A1* | 8/2016 | Kawarai | H01F 27/29 |
| 2017/0018351 | A1* | 1/2017 | Yatabe | H01F 27/292 |

FOREIGN PATENT DOCUMENTS

| | | | |
|---|---|---|---|
| CN | 101553891 | A | 10/2009 |
| CN | 102290194 | A | 12/2011 |
| JP | 06-215942 | A | 8/1994 |
| JP | 2013-098356 | A | 5/2013 |

(Continued)

OTHER PUBLICATIONS

Korean Office Action dated Aug. 19, 2016, issued in Korean patent application No. 10-2015-0115949. (w/ English translation).

(Continued)

*Primary Examiner* — Mangtin Lian
(74) *Attorney, Agent, or Firm* — McDermott Will & Emery LLP

(57) ABSTRACT

A coil electronic component includes a magnetic body in which a coil having leads exposed to side surfaces of the coil is disposed. External terminals are connected to the leads and disposed on outer surfaces of the magnetic body. Additionally, the external terminals are folded to have side surface portions which are disposed on end surfaces of the magnetic body, and bottom surface portions which are disposed on a bottom surface of the magnetic body.

16 Claims, 4 Drawing Sheets

(56) References Cited

FOREIGN PATENT DOCUMENTS

| | | | |
|---|---|---|---|
| KR | 10-0861102 | B1 | 10/2008 |
| KR | 10-2014-0063032 | A | 5/2014 |
| KR | 10-2015-0044372 | A | 4/2015 |
| WO | 2008021958 | A2 | 2/2008 |

OTHER PUBLICATIONS

First Office Action in corresponding Chinese Patent Application No. 201610213581.6, dated Nov. 3, 2017 (with full English translation).
Second Office Action issued in Chinese Patent Appiication No. 201813213581.6, dated Sep. 7, 2018 (English translation)

* cited by examiner

COIL ELECTRONIC COMPONENT

CROSS-REFERENCE TO RELATED APPLICATION

This application claims the priority and benefit of Korean Patent Application No. 10-2015-0115949, filed on Aug. 18, 2015 with the Korean Intellectual Property Office, the disclosure of which is incorporated herein by reference.

TECHNICAL FIELD

The present disclosure relates to a coil electronic component.

BACKGROUND

An inductor is an electronic component that functions as a passive element commonly used in electronic circuits together with a resistor and a capacitor to remove noise.

In accordance with the recent development of portable devices such as smartphones, tablet PCs, and the like, a sufficient current required for portable devices cannot generally be provided by existing ferrite inductor due to an expansion in current needs of accelerated processing units (APUs) having high speed and a wide display.

To address this shortcoming, many metal composite inductors, or the like, have recently been developed in which a metal powder having good DC-bias characteristics and an organic material are used. Examples of these inductors include winding inductors.

Examples of winding inductors include straight angle winding inductors, edge-wise winding inductors, lead frame type inductors, metal mold winding inductors, and the like. Among these, the lead frame type inductor makes up the majority of large metal winding inductors, but miniaturization thereof has been difficult.

SUMMARY

An aspect of the present disclosure may provide a coil electronic component capable of implementing lower direct current (DC) resistance (Rdc) and excellent DC-bias characteristics by a new lead structure of a coil having a vertical direction.

According to an aspect of the present disclosure, a coil electronic component includes a magnetic body in which a coil having leads exposed to side surfaces of the coil is disposed, and external terminals connected to the leads and disposed on outer surfaces of the magnetic body. The external terminals are folded to have side surface portions which are disposed on end surfaces of the magnetic body, and bottom surface portions which are disposed on a bottom surface of the magnetic body.

According to another aspect of the present disclosure, a coil electronic component includes a magnetic body in which a coil having leads exposed to side surfaces of the magnetic body is disposed, and external terminals connected to the leads and disposed on an outer surface of the magnetic body. The external terminals have side surface portions disposed on end surfaces of the magnetic body in a length direction of the magnetic body, and bottom surface portions disposed on a bottom surface of the magnetic body.

According to a further aspect of the present disclosure, a coil electronic component includes a coil having first and second leads, and first and second external terminals each connected to a respective one of the first and second leads.

Each of the first and second external terminals is an integrally formed polyhedron that includes a side surface portion shaped as a hexahedron, a bottom surface portion shaped as a hexahedron, and having a main surface that is non-parallel to a main surface of the side surface portion, and an exposed portion contacting the respective one of the first and second leads, shaped as a hexahedron, and having a main surface that is non-parallel to main surfaces of the side surface portion and the bottom surface portion.

BRIEF DESCRIPTION OF DRAWINGS

The above and other aspects, features, and other advantages of the present disclosure will be more clearly understood from the following detailed description taken in conjunction with the accompanying drawings, in which.

DETAILED DESCRIPTION

Figure 1:
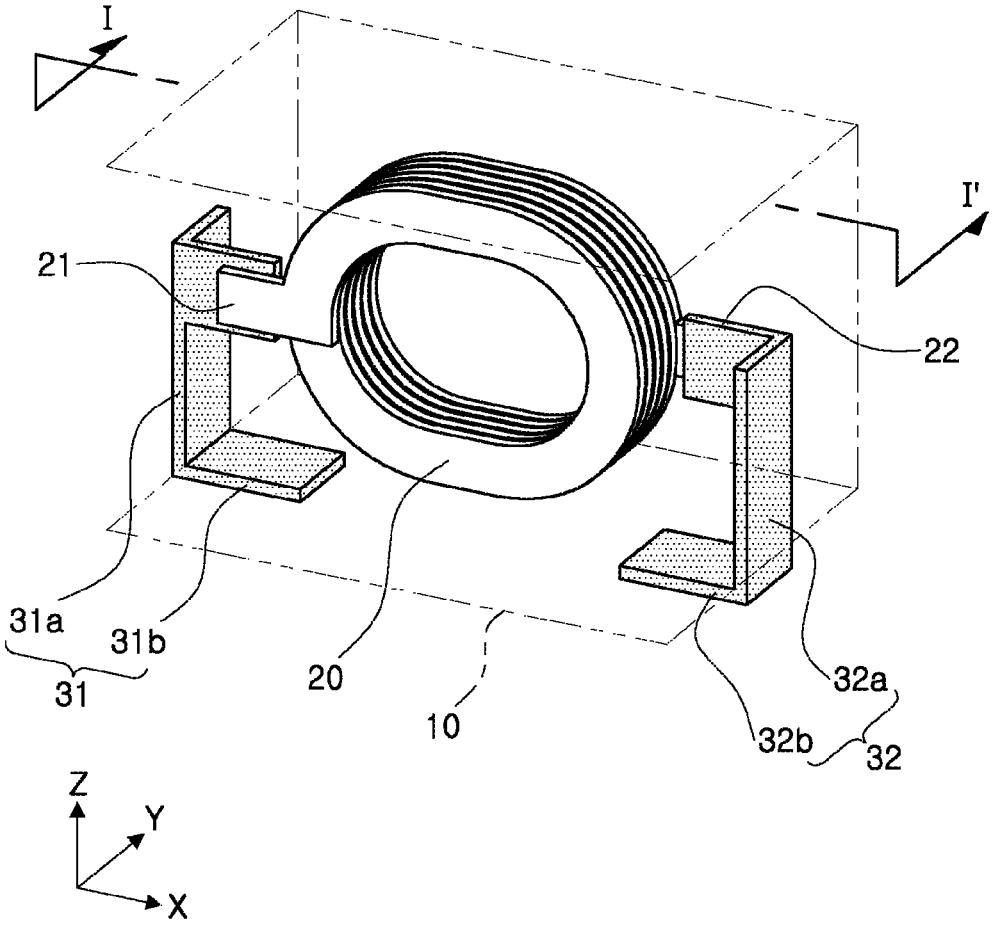
FIG. 1 is a schematic perspective view illustrating a coil electronic component according to an exemplary embodiment.

Hereinafter, embodiments of the present inventive concepts will be described with reference to the attached drawings.

The present inventive concepts may, however, be exemplified in many different forms and should not be construed as being limited to the specific embodiments set forth herein. Rather, these embodiments are provided so that this disclosure will be thorough and complete, and will fully convey the scope of the inventive concepts to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another member, component, region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's positional relationship relative to other element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present inventive concepts will be described with reference to schematic views illustrating embodiments of the present inventive concepts. In the drawings, components having ideal shapes are shown. However, variations from these shapes, for example due to variability in manufacturing techniques and/or tolerances also fall within the scope of the disclosure. Thus, embodiments of the present inventive concept should not be construed as being limited to the particular shapes of regions shown herein, but should more generally be understood to include changes in shape resulting from manufacturing methods and processes. The following embodiments may also be constituted by one or a combination thereof.

The present inventive concepts described below may be implemented in a variety of configurations, and the description below describes only some illustrative configurations. However, one of skill in the art will understand that the inventive concepts, but are not limited to the particular configurations shown herein, but extend to other configurations as well.

FIG. 1 is a schematic perspective view illustrating a coil electronic component in which a coil, a lead, and an external terminal of the coil electronic component according to an exemplary embodiment are visible.

Figure 2:
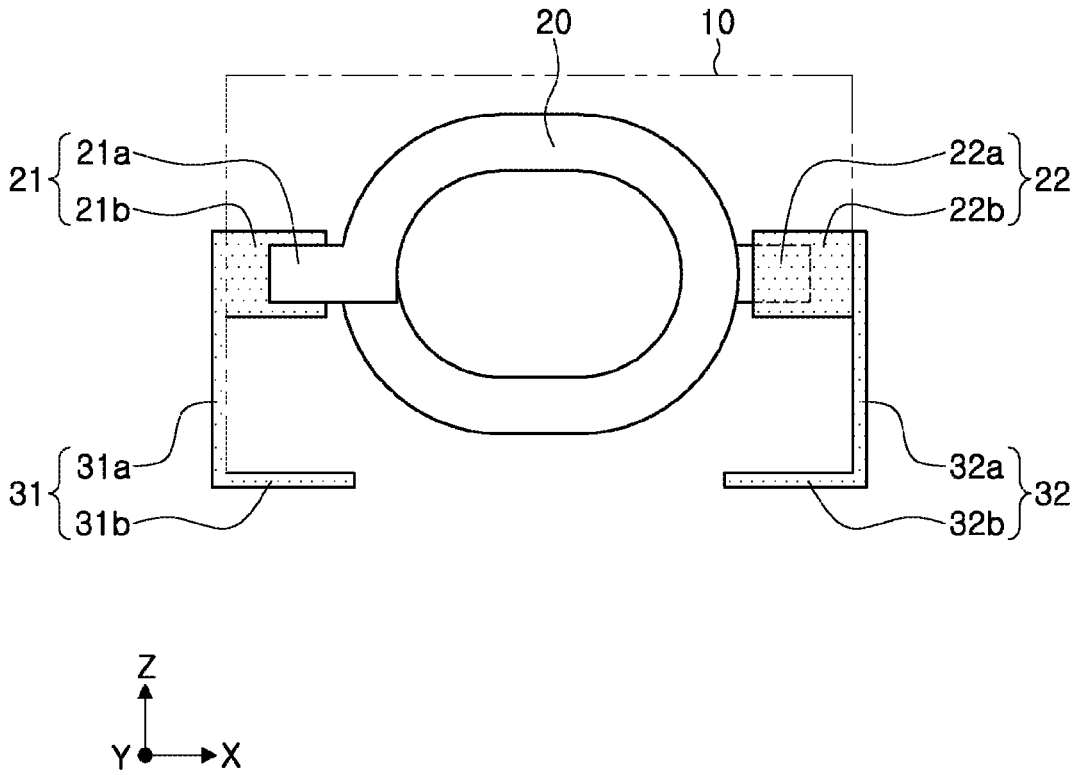
FIG. 2 is a cross-sectional view taken along line I-I' of FIG. 1.

FIG. 2 is a cross-sectional view taken along line I-I' of FIG. 1.

Referring to FIGS. 1 and 2, a coil electronic component according to an exemplary embodiment may include a magnetic body 10 in which a coil 20 having leads 21 and 22 exposed to side surfaces of the coil 20 is disposed, and external terminals 31 and 32 connected to the leads 21 and 22 and disposed on an outer surface of the magnetic body 10. The external terminals 31 and 32 may have side surface portions 31*a* and 32*a* which are folded in a width direction of the magnetic body 10 to be disposed on (and parallel to) outer lateral end surfaces of the magnetic body 10, and bottom surface portions 31*b* and 32*b* which are folded in a bottom surface direction of the magnetic body 10 to be disposed on (and parallel to) a bottom surface of the magnetic body 10. In this regard, we note that the external terminals 31 and 32 are each shaped as a polyhedron, each of the side surface portions 31*a* and 32*a*, the bottom surface portions 31*b* and 32*b*, and the exposed portions 21*b* and 22*b* of the leads 21 and 22 are shaped as hexahedrons.

The magnetic body 10 may have the bottom surface provided as a mounting surface, a top surface opposite to the bottom surface, two end surfaces in a length direction of the magnetic body 10, and two side surfaces in a width direction of the magnetic body 10.

A shape of the magnetic body 10 is not particularly limited. For example, the shape of the magnetic body 10 may be a hexahedron shape. Here, as directions of the hexahedron, the x direction indicated in FIG. 1 may denote a length direction, the y direction may denote a width direction, and the z direction may denote a thickness direction.

The magnetic body 10 may include a core member therein. Here, the core member may have a cross section of a circle or a circular shape so that a length of the core member is shorter than a length of a coil 20 required to obtain a predetermined number of windings.

Further, the core member may generally be of a columnar shape, but is not limited thereto.

Meanwhile, when a current is applied to the coil 20 through the external terminals 31 and 32 in the magnetic body 10, a path (magnetic path) through which magnetic flux induced from the coil 20 passes may be formed in the core member.

The magnetic body 10 may be formed of magnetic alloy particles, and an insulating material may be included between the magnetic alloy particles. Here, the magnetic alloy particles may be an Fe—Cr—Si alloy, an Fe—Si—Al alloy, or the like which has high electrical resistance, low loss of magnetic properties, and easily implements impedance through a change in composition. Further, as a thermal change insulating material, an epoxy resin, a phenol resin, polyester, or the like may be used.

The coil 20 may include a spiral portion wound to have a predetermined number of windings, and lead portions 21 and 22 led to both ends of the spiral portion.

The coil 20 may be formed of a metal wire which may be formed of copper (Cu), silver (Ag), or the like.

Further, the coil 20 is not limited to a single wire, and may be formed of a flexible wire or two or more wires. Further, the metal wire of the coil 20 is not limited to having a circular cross section shape, and may also have a quadrangular cross section shape.

As an example, the metal wire of the coil 20 may be wound in an alpha winding manner as a flat wire coil form.

Further, a pair of lead portions 21 and 22 which are each led from the spiral portion may be extended to be connected to the external terminals 31 and 32 formed on both end surfaces of the magnetic body 10 in the length direction thereof.

That is, in FIG. 1, a left lead portion 21 led from one end of the spiral portion may be connected to a left external terminal 31, and a right lead portion 22 led from the other end of the spiral portion may be connected a right external terminal 32.

The external terminals 31 and 32 may have the side surface portions 31*a* and 32*a* which are folded in the width direction of the magnetic body 10, and the bottom surface portions 31*b* and 32*b* which are folded in the bottom surface direction of the magnetic body 10.

According to an exemplary embodiment, the coil 20 may be disposed to be perpendicular to the bottom surface of the magnetic body 10. In particular, a main axis of the coil (corresponding to a direction of magnetic flux flowing through the coil as a result of current flowing through the coil) may be parallel to the bottom surface of the magnetic body 10.

In general, as a product is miniaturized, many products having a thickness greater than a width of a coil electronic component are developed.

Particularly, in a recent case in which there is a thickness limit of 0.8 mm, since a product of 1608 size (length×width×thickness is 1.6 mm×0.8 mm×0.8 mm) has the same width and thickness as 0.8 mm, there is no problem, but a product of 1005 size (length×width×thickness is 1.0 mm×0.5 mm×0.5 mm) may improve electrical characteristics by increasing the thickness to have an increased volume when being manufactured at the thickness of 0.5 mm.

In order to design the coil having low direct current (DC) resistance (Rdc) and excellent DC-bias characteristics, since it is advantageous to wind an inner area of the coil in a width direction, a structure in which a coil of an inductor is wound to be perpendicular to a mounting surface is manufactured.

However, in a case in which the coil is disposed to be perpendicular to the mounting surface, since a lead direction of the lead is changed at 90° from a folding direction of the lead, it is difficult to bend the lead in an existing direction. There is therefore a problem in that it is difficult to form the external terminals of the coil electronic component.

In order to solve the above-mentioned problem, a method for externally welding or soldering the lead after performing a shaping except for the lead, or the like, may also be implemented, but there has been a problem that such a process complicates manufacturing processes.

According to an exemplary embodiment, a structure capable of changing the lead direction at 90° when folding the lead may be provided by providing a new lead structure that is especially well suited for use in cases in which the coil is disposed to be perpendicular to the mounting surface.

That is, even if the coil is disposed to be perpendicular to the mounting surface, since the external terminals may be implemented with a simple process by the new lead structure, the coil electronic component having low DC resistance (Rdc) and excellent DC-bias characteristics may be implemented.

A direction of a magnetic field produced by the coil 20 upon application of current to the coil 20 may be the width direction of the magnetic body 10 (e.g., the y direction of FIG. 1).

The above-mentioned effect may be implemented by adjusting the external terminals 31 and 32 to have the side surface portions 31*a* and 32*a* which are folded in the width direction of the magnetic body 10, and the bottom surface portions 31*b* and 32*b* which are folded in the bottom surface direction of the magnetic body 10.

The side surface portions 31*a* and 32*a* folded in the width direction of the magnetic body 10 among the external terminals 31 and 32 may correspond to the structure changing the lead direction at 90° with respect to the leads 21 and 22 of the coil, unlike a general structure.

The leads 21 and 22 and the external terminals 31 and 32 may be integrally formed, the side surface portions 31*a* and 32*a* of the external terminals 31 and 32 may be formed by being folded in the width direction of the magnetic body 10, and the bottom surface portions 31*b* and 32*b* may be formed by being folded in the bottom surface direction of the magnetic body 10. As shown in the figures, the side surface portions 31*a* and 32*a* may be folded so as to be parallel to (and co-planar with) side surfaces of the magnetic body 10, and the bottom surface portions 31*b* and 32*b* may be folded so as to be parallel to (and co-planar with) the bottom surface of the magnetic body 10. In this regard, a main surface of each side surface portions 31*a* and 32*a* may be co-planar with a respective side surface of the magnetic body 10, and the a main surface of each bottom surface portions 31*b* and 32*b* may be co-planar with the bottom surface of the magnetic body 10.

Referring to FIG. 2, the leads 21 and 22 may include lead portions 21*a* and 22*a* led from both ends of the coil 20, and exposed portions 21*b* and 22*b* coupled to the lead portions 21*a* and 22*a* and exposed to the end surfaces of the magnetic body 10 in the length direction of the magnetic body 10.

The exposed portions 21*b* and 22*b* may be formed integrally with the external terminals 31 and 32.

The lead portions 21*a* and 22*a* and the exposed portions 21*b* and 22*b* may be coupled to each other by a method such as welding, soldering, or the like, but are not limited thereto.

Referring to FIG. 2, a space around the coil 20, which is disposed in the magnetic body 10, may be filled with a magnetic material, and both ends of the coil 20 may be connected to the external terminals 31 and 32, respectively.

As illustrated in FIG. 2, the coil 20 may also be positioned at the center of the magnetic body 10, and may also be positioned at an upper end or a lower end of the magnetic body 10 depending on design requirements or manufacturing process requirements.

According to exemplary embodiments, during manufacturing, the coil 20 may be seated in a cavity formed by using at least a portion of a support member (not illustrated) including a substrate, and the space around the coil may be filled with a magnetic resin composite. Thereby, the inductor may be miniaturized, and the coil 20 may be stably mounted in the magnetic body 10.

Figure 3:
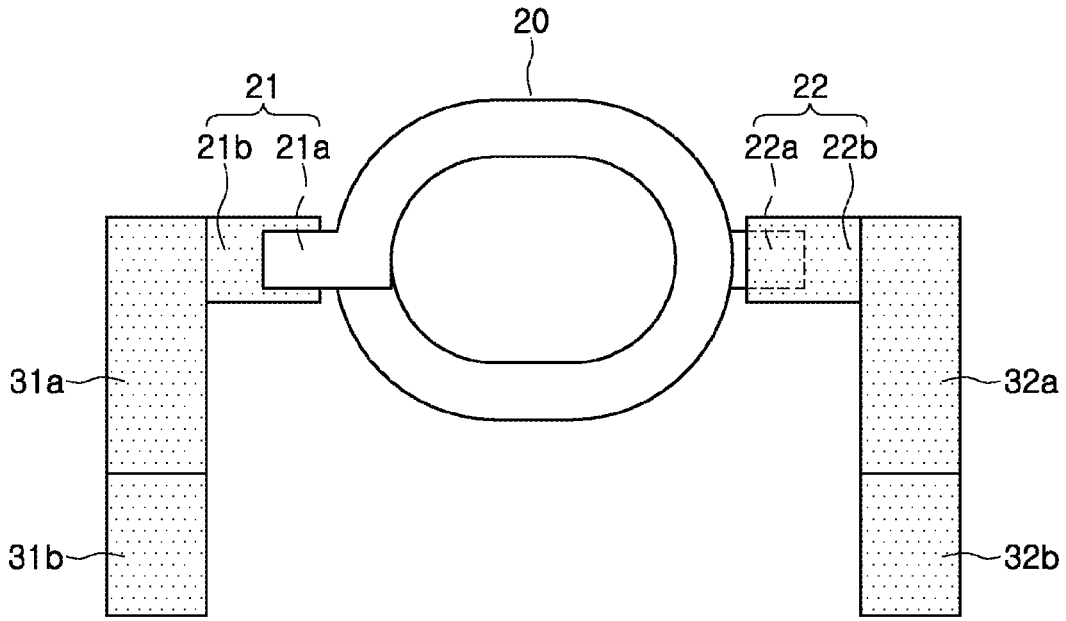
FIG. 3 is a schematic view illustrating a coil, a lead, and an external terminal in the positions they assume before being folded in the coil electronic component according to an exemplary embodiment.

FIG. 3 is a schematic view illustrating a coil, a lead, and external terminals in the positions they assume before being folded in the coil electronic component according to an exemplary embodiment.

Referring to FIG. 3, in the coil electronic component according to an exemplary embodiment, the coil 20, the leads 21 and 22, and the external terminals 31 and 32 before being folded are illustrated. As shown, the external terminals 31 and 32 are substantially flat (planar) before being folded. The leads 21 and 22 include the lead portions 21*a* and 22*a* led from both ends of the coil 20, and the exposed portions 21*b* and 22*b* coupled to the lead portions 21*a* and 22*a* and exposed to the end surface of the magnetic body 10 in the length direction of the magnetic body 10.

In the illustration of FIG. 3, solid lines in the external terminals 31 and 32 indicate lines along which the external terminals 31 and 32 are folded after forming the magnetic body 10.

That is, according to an exemplary embodiment, the external terminals 31 and 32 may be folded so as to form a structure having the side surface portions 31*a* and 32*a* which are folded in the width direction of the magnetic body 10, and the bottom surface portions 31*b* and 32*b* which are folded in the bottom surface direction of the magnetic body 10, as shown in FIGS. 1 and 2.

In various structure, the coil may be disposed to be parallel with the mounting surface (e.g., an axis of symmetry of the coil may be orthogonal to the lower surface of the magnetic body 10, which serves as the mounting surface, an axis of magnetic flux passing through the coil as a result of current flow through the coil conductor may be orthogonal to the lower surface, or the like). In these examples, the external terminals 31 and 32 may be shaped by bending the leads twice in the same direction. However, in a case in which the coil is disposed to be perpendicular to the mounting surface as in an exemplary embodiment shown in FIGS. 1 and 2 (e.g., in which the axis of symmetry of the coil is parallel to the lower surface of the magnetic body 10, which serves as the mounting surface, the axis of magnetic flux passing through the coil as a result of current flow through the coil conductor is parallel to the lower surface, or the like), when the leads are bent in the same direction, it is difficult to form the external terminals on the outer surface of the magnetic body 10.

That is, according to an exemplary embodiment, since the side surface portions 31*a* and 32*a* of the external terminals 31 and 32 are formed to be folded in the width direction by including a new lead structure, the external terminals may be stably formed.

Thereby, the coil electronic component having low DC resistance (Rdc) and excellent DC-bias characteristics may be implemented with a simple process.

A method for manufacturing a coil electronic component according to an exemplary embodiment is as follows:

First, the coil 20 may be disposed in at least a partially machined space of a support member. The support member may stably hold or seat the coil 20 prior to the forming of the magnetic body 10 such that the coil 20 is at a desired position within the magnetic body 10 when the magnetic body 10 is formed.

Here, the coil 20 may be a winding coil formed by a winding method, but is not limited thereto.

In addition, in order to provide a high capacity inductor, a core may be formed in an intermediate hole or through hole of the coil 20.

The magnetic body 10, which fills an inner portion of the coil electronic component and at the same time forms a body of the component, may fill spaces around the support member and the coil 20.

The magnetic body 10 may be formed of a magnetic resin composite in which magnetic metal powder and a resin mixture are mixed, to embed the support member and the coil 20.

Here, the magnetic metal powder may include Fe, Cr, or Si as a main component, and more particularly, may include amorphous Fe, Fe, Fe—Cr—Si, and the like.

In addition, the resin mixture may include at least one of epoxy, polyimide, and liquid crystal polymer (LCP), or a combination thereof.

The magnetic body 10 may be filled with magnetic metal powder having at least two or more particle sizes.

According to the exemplary embodiments, the magnetic resin composite may be fully provided by using and compressing bimodal magnetic metal powders having different sizes, thereby increasing a filling rate.

Particularly, the magnetic resin composite may be cured after the magnetic metal powder and the resin mixture are formed in a sheet type, and are laminated and compressed on at least one surface of the support member.

For example, the magnetic body 10 may include a material for obtaining high magnetic characteristics and DC-bias of the coil electronic component. Particularly, as the magnetic metal powder and the resin mixture, the magnetic metal powder may contain a coarse powder and a fine powder containing Fe, Cr, and Si as the main component, and the resin mixture may contain an epoxy-based resin.

Thereby, a sheet having a predetermined thickness may be shaped.

The coil 20 and the support member may be disposed to have a gap formed therebetween. A space between the coil 20 and the support member, which is formed when the coil 20 and the support member are disposed to have the gap, may be filled with a filling material forming the magnetic body 10.

Additionally, the coil electronic component may further include the external terminals 31 and 32, and the external terminals 31 and 32 may be connected to the leads 21 and 22 externally exposed from the coil 20.

Further, the external terminals 31 and 32 may be electrically connected to the leads 21 and 22 of the coil 20, and may be disposed at positions corresponding to both end portions of the magnetic body 10.

Here, the external terminals 31 and 32 may include a metal such as Ag, Ag—Pd, Ni, Cu, or the like, and a Ni plating layer and a Sn plating layer may be selectively formed on surfaces of the external terminals 31 and 32.

Figure 4:
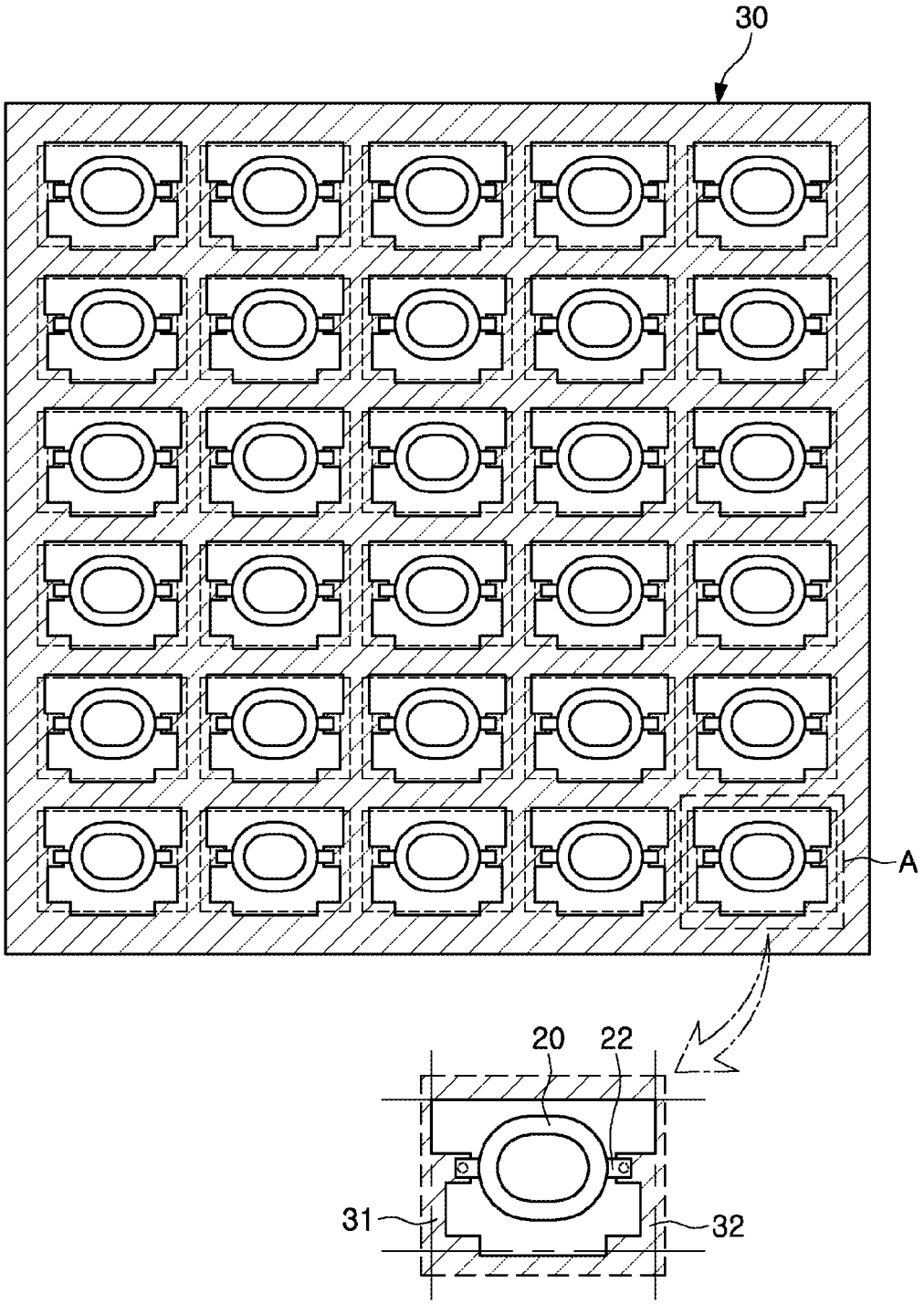
FIG. 4 is a schematic plan view illustrating an array of coil electronic components according to another exemplary embodiment.

FIG. 4 is a schematic plan view illustrating an array of coil electronic components according to another exemplary embodiment.

Figure 5:
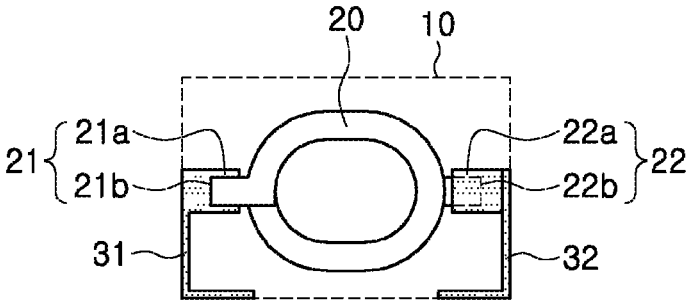
FIG. 5 is a schematic view illustrating a coil, a lead, and an external terminal of FIG. 4 after being diced.

FIG. 5 is a schematic view illustrating a coil, leads, and external terminals of FIG. 4 after being diced.

Referring to FIGS. 4 and 5, a coil electronic component according to another exemplary embodiment may include a coil 20 disposed in at least a partially machined space formed in a metal frame 30, and a magnetic body embedding the metal frame 30 and the coil 20.

That is, the coil electronic component according to another exemplary embodiment may include a magnetic body 10 in which a coil 20 having leads 21 and 22 exposed to side surfaces of the coil 20 is disposed, and external terminals 31 and 32 connected to the leads 21 and 22 and extending to an outer surface of the magnetic body 10. Portions of the external terminals 31 and 32 may be disposed on outer surface of the magnetic body 10, for example to be substantially parallel to the outer surfaces of the magnetic body 10 that they are disposed on. In particular, the external terminals 31 and 32 may have side surface portions 31*a* and 32*a* which are each disposed on a respective lateral end surface of the magnetic body 10 in a length direction of the magnetic body 10, and bottom surface portions 31*b* and 32*b* that are each disposed on a bottom surface of the magnetic body 10.

The coil electronic component according to another exemplary embodiment is different from the coil electronic component according to an exemplary embodiment in the present disclosure described above in regard to the external terminals 31 and 32.

In the coil electronic component according to an exemplary embodiment described above, the side surface portions 31*a* and 32*a* of the external terminals 31 and 32 are positioned such that they are folded in the width direction of the magnetic body 10, and the bottom surface portions 31*b* and 32*b* are positioned such that they are folded in the bottom surface direction of the magnetic body 10.

In contrast, in the coil electronic component according to another exemplary embodiment, the side surface portions of the external terminals 31 and 32 are not in a folded state, and may be automatically disposed on the end surface of the magnetic body in the length direction of the magnetic body. Additionally, the bottom surface portions may also be automatically disposed on the bottom surface of the magnetic body.

The leads 21 and 22, and the side surface portions 31*a* and 32*a* and the bottom surface portions 31*b* and 32*b* of the external terminals 31 and 32 may be integrally formed.

The leads 21 and 22 may include lead portions 21*a* and 22*a* led from both ends of the coil 20, and exposed portions 21*b* and 22*b* coupled to the lead portions 21*a* and 22*a* and exposed to the end surface of the magnetic body 10 in the length direction of the magnetic body 10.

The exposed portions 21*b* and 22*b*, and the side surface portions 31*a* and 32*a* and the bottom surface portions 31*b* and 32*b* of the external terminals 31 and 32 may be integrally formed by dicing the metal frame 30, and the leads 21 and 22 may be formed by welding the exposed portions 21*b* and 22*b* and the lead portions 21*a* and 22*a* together.

The at least partially machined space is formed in the metal frame 30, and thus the coil 20 may be disposed in the machined space, and the exposed portions 21*b* and 22*b* which may be connected to the lead portions 21*a* and 22*a* of the coil 20 may be formed on an inner side of the machined space in order to fix a position of the coil 20.

The above-mentioned exposed portions 21*b* and 22*b* may be formed by machining the metal frame 30, and may be formed in various shapes.

Referring to FIG. 4, after a different coil 20 is loaded in each of machined openings/spaces in the metal frame 30 in which the at least partially machined spaces are formed, a process such as welding, or the like, may be performed so that the lead portions 21*a* and 22*a* and the exposed portions 21*b* and 22*b* of the coil 20 may be connected to each other.

Next, a bulk structure may be generated by compressing and curing a magnetic sheet around the metal frame 30 and the coils 20.

Next, separate components may be generated by dicing the generated bulk structure.

Specifically, the bulk structure may be formed of a bar shape in which a plurality of coils 20 are regularly arranged, and the magnetic sheet formed of a magnetic resin composite is provided around the coils 20.

By manufacturing a separate component shape by dicing the above-mentioned bulk structure in horizontal and vertical directions at a designed component size, a dicing process may be performed.

For example, the bulk structure may be diced into the separate component shape by applying dicing equipment using a surface acoustic wave (SAW), and other dicing methods such as a blade method, a laser method, and the like may also be applied.

FIG. 5 illustrates an outcome manufactured in the separate component shape by dicing the bulk structure in the horizontal and vertical directions at a component size designed according to another exemplary embodiment.

In FIG. 5, a dotted line portion indicates a diced surface in horizontal and vertical directions. In a case in which the dicing is performed by the above-mentioned dicing method, since the leads 21 and 22 and the external terminals 31 and 32 are automatically formed, position precision of the coil 20 may be excellent, and a work process of separately forming or bending the external terminals 31 and 32 may not be additionally required.

Hereinafter, a method of manufacturing a coil electronic component according to another exemplary embodiment will be described in more detail.

First, a metal frame 30 may have an at least partially machined space.

The at least partially machined space of the metal frame described above may be a mounting space in which the coil 20 is disposed, and the coil 20 and the metal frame 30 may be formed to have a gap.

The coil 20 may be seated in the at least partially machined space of a pre-manufactured metal frame 30.

Here, the coil 20 may be a winding coil formed by a winding method.

In addition, the at least partially machined space of the metal frame 30 may accommodate all of a body of the coil 20 and two lead portions 21*a* and 22*a*.

The leads 21 and 22 of the coil 20 accommodated in the above-mentioned space may be connected to the external electrodes 31 and 32.

Next, in order to form the magnetic body 10 of the coil electronic component, the metal frame 30 and the coil 20 may be embedded by adding the magnetic resin composite to spaces around the metal frame 30 and the coil 20, and the magnetic resin composite may be compressed and then cured.

That is, the magnetic body 10 may be formed by embedding the metal frame 30 and the coil 20 by adding the magnetic resin composite in which magnetic metal powder and a resin mixture are mixed to the spaces around the metal frame 30 and the coil 20.

Particularly, the magnetic resin composite may be formed by laminating and compressing the metal magnetic powder and the resin mixture shaped in a sheet shape on at least one surface of the metal frame 30 and curing the metal magnetic powder and the resin mixture.

Here, the magnetic body 10 may be filled with the magnetic metal powders having at least two or more particle sizes, and the magnetic resin composite may be fully provided by using and compressing the metal magnetic powders having different sizes, thereby increasing a filling rate.

More specifically, in order to add, compress, and cure the magnetic resin composite, a first magnetic sheet in which the magnetic resin composite in which the magnetic metal powder and the resin mixture are mixed is shaped in a sheet shape may first be compressed and cured on a top surface of the metal frame 30.

Next, a second magnetic sheet in which the magnetic resin composite is shaped in the sheet shape may be compressed and cured on a bottom surface of the metal frame 30.

In the compressing and curing of the second magnetic sheet on the bottom surface of the metal frame 30, the coil 20 may be disposed at the center of the component by adjusting the laminated number of sheets compressed and cured on the second magnetic sheet and the first magnetic sheet.

As such, by implementing a magnetic sheet method to manufacture the coil electronic component, productivity may be improved and a mold ratio may be reduced, as compared to an existing winding coil method.

In addition, although not illustrated, a process of producing a separate component by dicing the metal frame and the magnetic resin composite in a separate component unit may be added.

In addition, after performing the dicing process, a plating blur may be prevented by forming an insulating layer on a surface of the magnetic resin composite forming the magnetic body 10.

Here, the insulating layer may be formed of one or more of a glass based material including Si, an insulating resin, and plasma.

Further, a concave-convex form on a surface of the diced magnetic body 10 may be significantly reduced to prevent the plating blur, thereby preventing current concentration upon applying a plating current.

That is, a diced and exposed surface of the magnetic body 10 forms a planarized semi-spherical shape or a shape in which a portion of a sphere is diced, and thus the magnetic body 10 may be implemented in a structure of which a surface is flat, thereby preventing the current concentration upon applying the plating current.

When dicing is performed, since the dicing is performed along the dotted line portion in FIG. 5, the leads 21 and 22 and the external terminals 31 and 32 may be automatically formed. As a result, a position precision of the coil 20 may be excellent, and a process of separately forming or bending the external terminals 31 and 32 may not be additionally required.

As set forth above, according to the exemplary embodiment in the present disclosure, the coil electronic component having low DC resistance (Rdc) and excellent DC-bias characteristics may be implemented with the simple process by the structure capable of changing the lead direction at 90° when the lead is folded, by providing the new lead structure of the coil of the vertical direction.

According to another exemplary embodiment, since the new lead structure of the coil of the vertical direction may be implemented by welding and dicing the coil on the metal frame, problems of position precision of the coil and the formation of the external terminal may be simultaneously solved, and the coil electronic component having low DC resistance (Rdc) and excellent DC-bias characteristics may be implemented with the simple process.

While exemplary embodiments have been shown and described above, it will be apparent to those skilled in the art that modifications and variations could be made without departing from the scope of the present invention as defined by the appended claims.

What is claimed is:

1. A coil electronic component comprising:

a magnetic body in which a coil having leads exposed to side surfaces of the coil is disposed; and external terminals connected to the leads and disposed on outer surfaces of the magnetic body, wherein the external terminals each include a side surface portion and a bottom surface portion, the side surface portions being disposed on end surfaces of the magnetic body, the bottom surface portions being folded in a direction perpendicular to the stacking direction of the coil the leads include lead portions led from both ends of the coil, and exposed portions coupled to the lead portions and exposed at opposing end surfaces of the magnetic body in a length direction of the magnetic body, the external terminals are integrally formed with the exposed portions of the leads, the stacking direction of the coil is parallel to the bottom surface of the magnetic body, the leads are disposed to be perpendicular to the stacking direction of the coil, the bottom surface of the magnetic body and the side surface portions of the external terminals, widths of the bottom surface portions and side surface portions are less than a width of the magnetic body, and the leads include a first lead and a second lead, and a lead portion of the first lead is disposed between an exposed portion of the first lead and a first side surface of the magnetic body, and a lead portion of the second lead is disposed between an exposed portion of the second lead and a second side surface of the magnetic body, the second side surface being opposed to the first side surface of the magnetic body.

2. The coil electronic component of claim 1, wherein the leads are formed by welding the exposed portions and the lead portions.

3. The coil electronic component of claim 1, wherein the coil is disposed such that a direction of a magnetic field produced when a current is applied to the coil is parallel to the bottom surface of the magnetic body.

4. The coil electronic component of claim 1, wherein the side surface portions and bottom surface portions of the external terminal have substantially planar surfaces, a main planar surface of each side surface portion is parallel to a corresponding end surface of the magnetic body, and a main planar surface of each bottom surface portion is parallel to the bottom surface of the magnetic body.

5. The coil electronic component of claim 4, wherein the main planar surface of each side surface portion is co-planar with the corresponding end surface of the magnetic body, and the main planar surface of each bottom surface portion is co-planar with the bottom surface of the magnetic body.

6. A coil electronic component comprising:

a magnetic body in which a coil having leads exposed to side surfaces of the magnetic body is disposed; and external terminals connected to the leads and disposed on an outer surface of the magnetic body, wherein the external terminals each include a side surface portion and a bottom surface portion, the side surface portions being disposed on end surfaces of the magnetic body in a length direction of the magnetic body, the bottom surface portions being folded in a direction perpendicular to the stacking direction of the coil the leads include lead portions led from both ends of the coil, and exposed portions coupled to the lead portions and exposed at opposing end surfaces of the magnetic body in the length direction of the magnetic body, the external terminals are integrally formed with the exposed portions of the leads, the stacking direction of the coil is parallel to the bottom surface of the magnetic body, the leads are disposed to be perpendicular to the stacking direction of the coil, and the bottom surface portions and the side surface portions of the external terminals, widths of the bottom surface portions and side surface portions are less than a width of the magnetic body, and the leads include a first lead and a second lead, and a lead portion of the first lead is disposed between an exposed portion of the first lead and a first side surface of the magnetic body, and a lead portion of the second lead is disposed between an exposed portion of the second lead and a second side surface of the magnetic body, the second side surface being opposed to the first side surface of the magnetic body.

7. The coil electronic component of claim 6, wherein the exposed portions, the side surface portions, and the bottom surface portions of the external terminals are integrally formed by dicing a metal frame, and the leads are formed by welding the exposed portions and the lead portions to each other.

8. The coil electronic component of claim 6, wherein the coil is disposed such that a direction of a magnetic field produced when a current is applied to the coil is parallel to the bottom surface of the magnetic body.

9. The coil electronic component of claim 6, wherein a main planar surface of each side surface portion of each external terminal is parallel to a corresponding end surface of the magnetic body, and a main planar surface of each bottom surface portion of each external terminal is parallel to the bottom surface of the magnetic body.

10. The coil electronic component of claim 9, wherein the main planar surface of each side surface portion is co-planar with the corresponding end surface of the magnetic body, and the main planar surface of each bottom surface portion is co-planar with the bottom surface of the magnetic body.

11. A coil electronic component comprising:

a coil having first and second leads; and first and second external terminals each connected to a respective one of the first and second leads, wherein each of the first and second external terminals is an integrally formed polyhedron including:

a side surface portion shaped as a hexahedron; and a bottom surface portion shaped as a hexahedron, and having a main surface that is non-parallel to a main surface of the side surface portion and parallel to a stacking direction of the coil;

the first and second leads include lead portions led from both ends of the coil, and exposed portions coupled to the lead portions and exposed at opposing end surfaces of the magnetic body in a length direction of the magnetic body, the external terminals are integrally formed with the exposed portions of the leads, a stacking direction of the coil is parallel to a bottom surface of the magnetic body, the first and second leads are disposed to be perpendicular to the stacking direction of the coil and the side surface portions and bottom surface portions of the first and second external terminals, each of the first and second external terminals is bent in a direction parallel to the stacking direction of the coil and parallel to the bottom surface portion to form the side surface portion, and a direction perpendicular to the stacking direction of the coil to form the bottom surface portion, widths of the bottom surface portions and side surface portions are less than a width of the magnetic body, and a lead portion of the first lead is disposed between an exposed portion of the first lead and a first side surface of the magnetic body, and a lead portion of the second lead is disposed between an exposed portion of the second lead and a second side surface of the magnetic body, the second side surface being opposed to the first side surface of the magnetic body.

12. The coil electronic component of claim 11, wherein a main surface of a hexahedron is a largest planar surface of the hexahedron, and the main surfaces of the exposed portions of the first and second external terminals are orthogonal to the main surfaces of the side surface portions and the bottom surface portions of the first and second external terminals.

13. The coil electronic component of claim 11, wherein the main surfaces of the side surface portions of the first and second external terminals are parallel to each other, the main surfaces of the exposed portions of the first and second external terminals are parallel to each other, and the main surfaces of the bottom surface portions of the first and second external terminals are co-planar with each other.

14. The coil electronic component of claim 11, wherein the coil is disposed such that a direction of a magnetic field produced when a current is applied to the coil is parallel to the main surfaces of each of the side surface portions and the bottom surface portions of the first and second external terminals.

15. The coil electronic component of claim 11, further comprising:

a magnetic body in which the coil is disposed, wherein the magnetic body has a substantially hexahedron shape, the side surface portions of the first and second external terminals are disposed on side surfaces of the magnetic body, and the bottom surface portions of the first and second external terminals are disposed on a bottom surface of the magnetic body.

16. The coil electronic component of claim 15, wherein the coil has an oval shape having an long axis, and the side surface portions of the first and second external terminals are disposed on side surfaces of the magnetic body that are opposite each other in a direction of the long axis of the oval shape coil.

* * * * *